US005782509A

United States Patent [19]

Uyeda

[11] Patent Number: 5,782,509

[45] Date of Patent: Jul. 21, 1998

[54] BOLT CLOSURE MAINTENANCE FOR FIRE-DEGRADED LATCHING ASSEMBLY

[75] Inventor: Alan K. Uyeda, Trabuco Canyon, Calif.

[73] Assignee: Adams Rite Manufacturing Co., City of Industry, Calif.

[21] Appl. No.: 802,435

[22] Filed: Feb. 18, 1997

[51] Int. Cl.[6] ..... E05B 65/10; E05B 15/02; E05B 17/20

[52] U.S. Cl. ..... 292/DIG. 66; 292/92; 292/341.17; 70/DIG. 10

[58] Field of Search ..... 292/92, 207, 341.16, 292/341.17, DIG. 66; 70/DIG. 10

[56] References Cited

U.S. PATENT DOCUMENTS

| | | | |
|---|---|---|---|
| Re. 30,263 | 4/1980 | Horvath | 292/341.16 |
| 1,203,116 | 10/1916 | Hurd . | |
| 1,516,628 | 11/1924 | Blackwell . | |
| 1,529,353 | 3/1925 | Hall . | |
| 1,544,960 | 7/1925 | Watts . | |
| 1,638,748 | 8/1927 | Santee . | |
| 2,219,344 | 10/1940 | Taylor . | |
| 2,458,751 | 1/1949 | Voight . | |
| 2,889,164 | 6/1959 | Clark . | |
| 3,281,176 | 10/1966 | McKey . | |
| 3,705,739 | 12/1972 | Adler | 292/92 |
| 4,003,593 | 1/1977 | Wilzig et al. | 292/DIG. 66 |
| 4,083,590 | 4/1978 | Folger . | |
| 4,130,306 | 12/1978 | Brkic . | |
| 4,145,900 | 3/1979 | Ohno . | |
| 4,183,565 | 1/1980 | Allemann . | |
| 4,311,329 | 1/1982 | Kral . | |
| 4,368,905 | 1/1983 | Hirschbein . | |
| 4,458,928 | 7/1984 | Hirschbein . | |
| 4,461,160 | 7/1984 | Van Gompel . | |
| 4,598,939 | 7/1986 | Krupicka et al. . | |
| 4,709,950 | 12/1987 | Zortman | 292/DIG. 66 |
| 4,714,285 | 12/1987 | Langham . | |
| 4,726,613 | 2/1988 | Foshee . | |
| 4,824,150 | 4/1989 | Smith et al. . | |
| 4,838,587 | 6/1989 | Choi . | |
| 4,906,034 | 3/1990 | Verslycken . | |
| 5,121,950 | 6/1992 | Davidian | 292/DIG. 66 |
| 5,456,243 | 10/1995 | Jones . | |
| 5,464,259 | 11/1995 | Cohrs et al. . | |
| 5,527,074 | 6/1996 | Yeh . | |
| 5,588,686 | 12/1996 | Riley et al. . | |

FOREIGN PATENT DOCUMENTS

| | | | |
|---|---|---|---|
| 471112 | 2/1992 | European Pat. Off. | 292/DIG. 66 |
| 2080391 | 6/1981 | United Kingdom . | |

*Primary Examiner*—Kenneth J. Dorner
*Assistant Examiner*—Robert G. Santos
*Attorney, Agent, or Firm*—William W. Haefliger

[57] ABSTRACT

In a door closure assembly, the combination comprising a latch bolt element; carrier structure to carry the bolt element to pivot between door unlatched and latched position; and means carried by a fire resistant portion of the assembly to be responsive to an increase in temperature to a level T to move into position to block door unlatching movement of the bolt element from door latching position.

10 Claims, 6 Drawing Sheets

BOLT CLOSURE MAINTENANCE FOR FIRE-DEGRADED LATCHING ASSEMBLY

BACKGROUND OF THE INVENTION

This invention relates generally to latches, and more particularly to mechanism operable to retain a latch in door closed locking position as during a fire.

There is need for a small sized, compact, easily installed mechanism which will prevent opening of a door as during a fire. Such opening would otherwise enable spread of the fire. Such a device should not prevent normal opening and closing of the door, but should only come into operation when ambient temperature rises to a selected level T. The door may be latched and unlatched as by electrically operated mechanism as described in U.S. Pat. No. 4,986,584, incorporated herein by reference.

SUMMARY OF THE INVENTION

It is a major object of the invention to provide improved mechanism meeting the above need. Basically, such mechanism comprises:

a) a latch bolt element, b) carrier structure to carry the bolt element to pivot between door unlatched and latched positions, c) and means carried by a fire resistant portion of the assembly to be responsive to an increase in temperature to a level T to move into position to block door unlatching movement of the bolt element from door latching position.

It is a further object of the invention to provide such means in the form of a blocking part urged in a direction of movement of the part into blocking relation to bolt pivoting toward unlatched position, and a meltable or fusible element preventing movement of the blocking part until the temperature of the meltable element rises to temperature T causing melting of the element. As will be seen, the meltable element is typically positioned to obstruct such movement of the blocking part, and a spring is provided to urge the blocking part in its movement direction.

Another object of the invention is to provide the blocking part in the form of a plunger movable endwise in a chamber, in said direction, the meltable element also positioned in the chamber. The plunger may advantageously have a flange and a blocking shank projecting in said direction beyond said flange, and the meltable element is positioned to extend about the shank in the endwise path of movement of the flange. The plunger may itself have a bore to receive the spring, providing a very compact assembly.

Yet another object is to support the plunger and meltable element in a chamber formed by a sub-cover carried as by a door frame; or, alternatively, to support the plunger and meltable element in a chamber formed by the bolt.

These and other objects and advantages of the invention, as well as the details of an illustrative embodiment, will be more fully understood from the following specification and drawings, in which:

DRAWING DESCRIPTION

DETAILED DESCRIPTION

Figure 1:
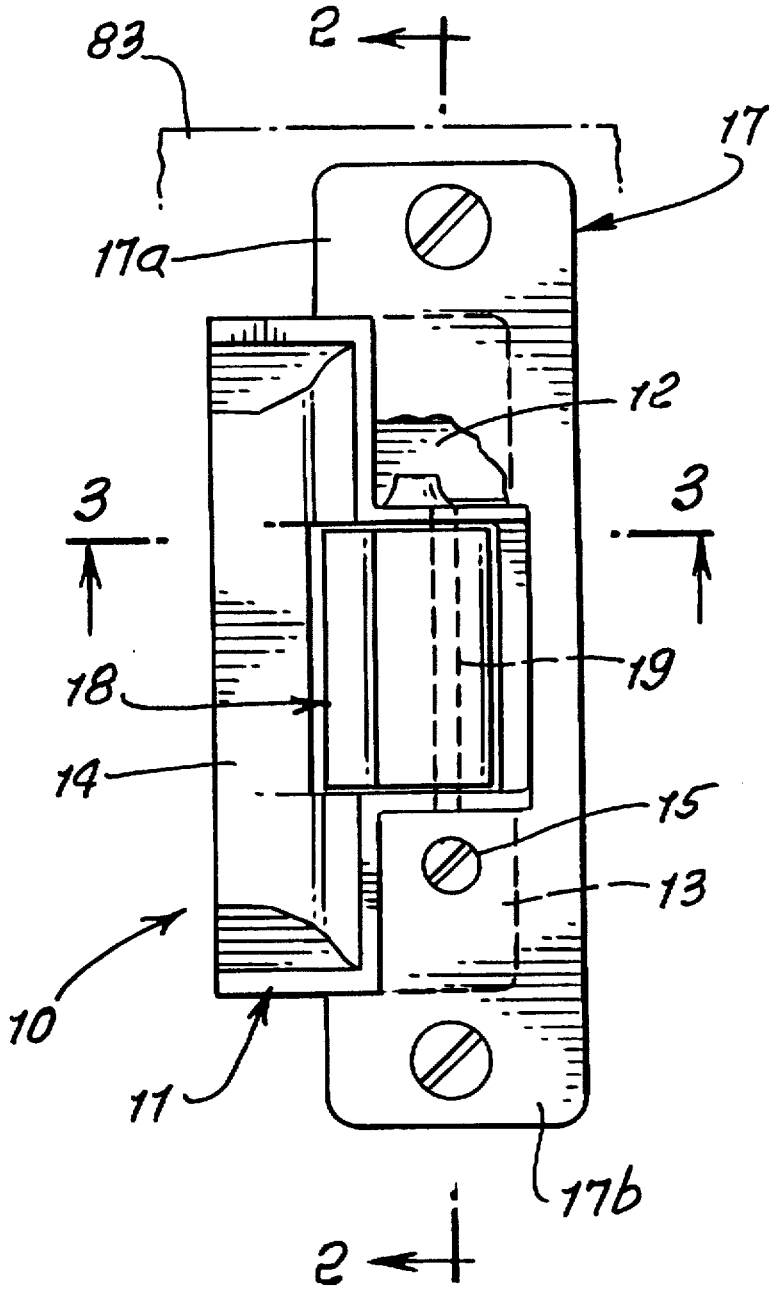
FIG. 1 is an elevation showing a bolt that is pivotable relative to a sub-cover.
Figure 2:
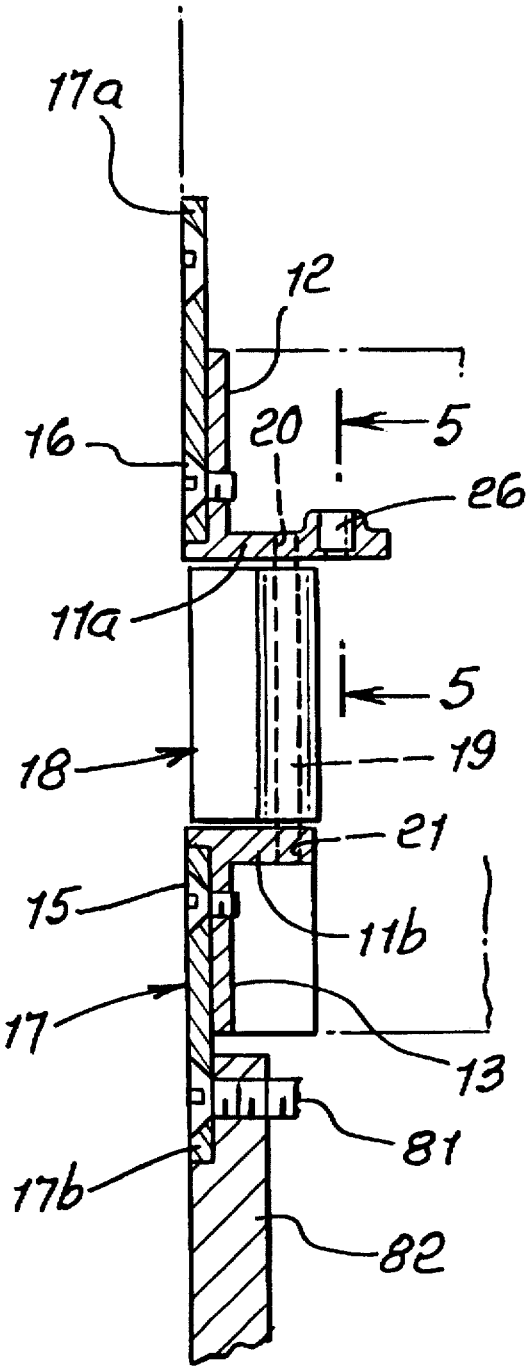
FIG. 2 is a vertical section taken on lines 2—2 of FIG. 1.
Figure 3:
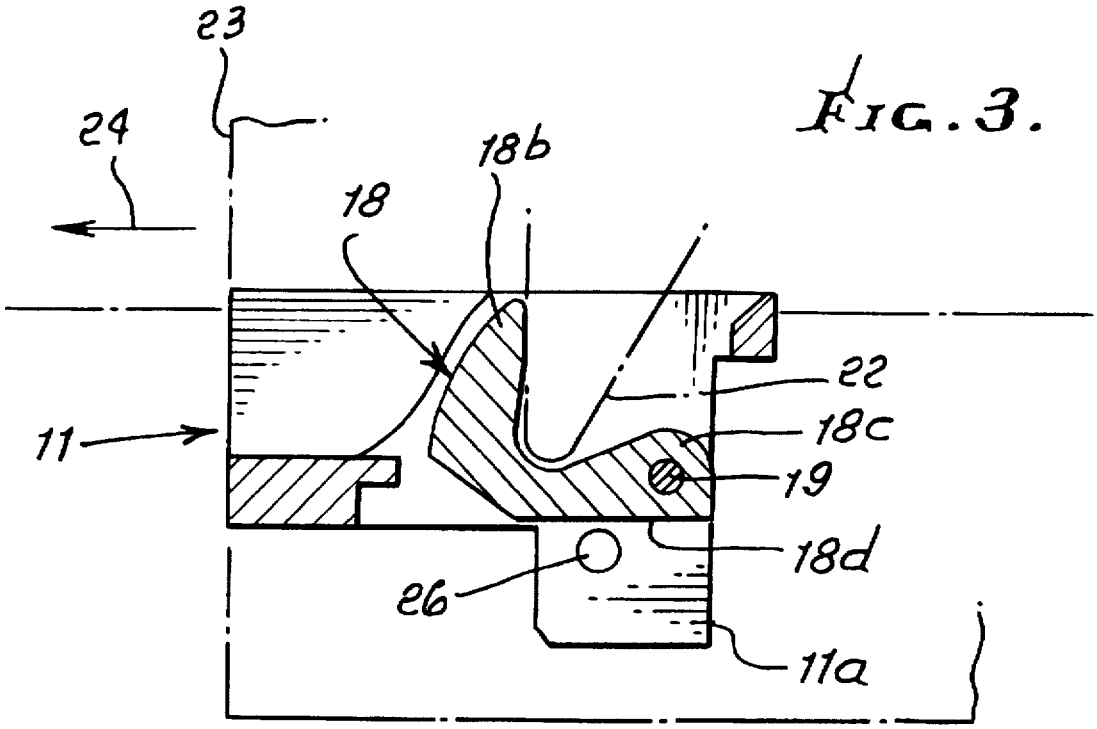
FIG. 3 is an enlarged section taken on lines 3—3 of FIG. 1.
Figure 4:
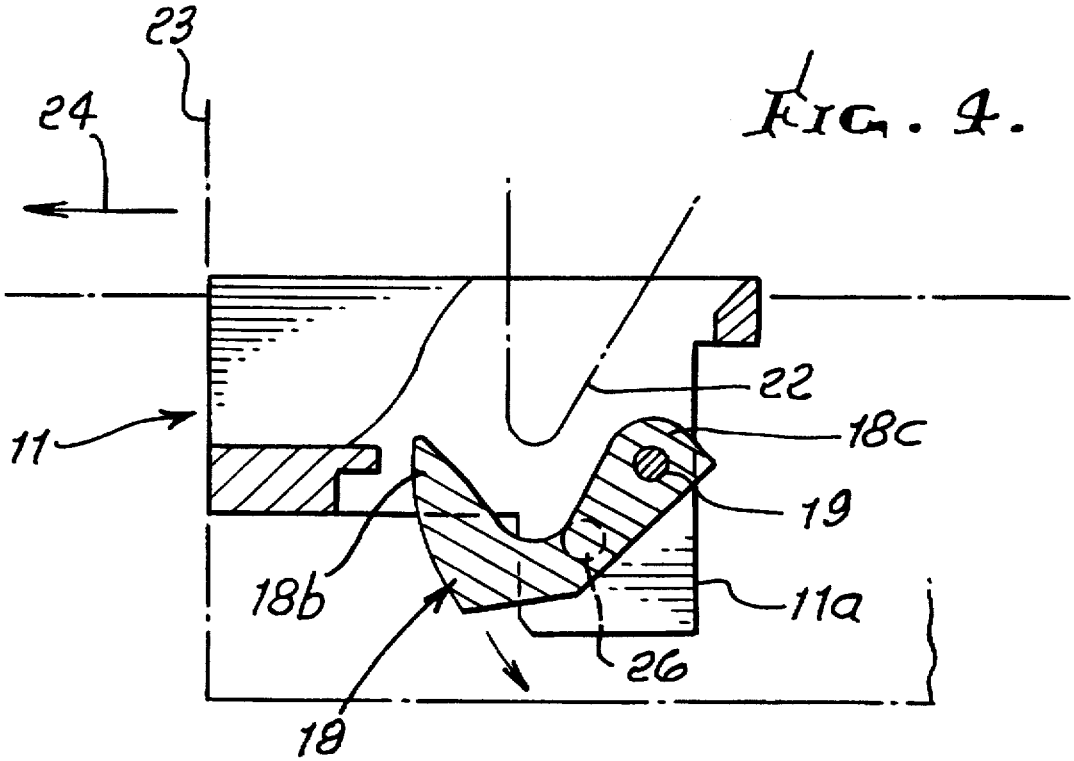
FIG. 4 is a view like FIG. 3, showing the bolt in unlatched position.

As shown in FIGS. 1 and 2, device 10 includes a latch carrier such as sub-cover 11 having upper and lower walls 12 and 13, integral with wall 14. The sub-cover is attached as by fasteners 15 and 16 to a mounting plate 17. The plate may have flanges or tabs 17*a* and 17*b* to be attached as by fasteners 81 to a wall such as door frame 82. A vertically elongated strike bolt 18 is pivotally attached to the sub-cover as by a vertically elongated pin 19 received through an opening in bolt flange or flanges 18*c* seen in FIGS. 3 and 4. Opposite ends of the pin are retained in openings 20 and 21 in sub-cover flanges 11*a* and 11*b* (see FIG. 2), whereby the bolt pivots about the vertical axis of the pin between locked condition as seen in FIG. 3, and unlocked condition as seen in FIG. 4.

In locked condition, the hook 18*b* of the bolt overlaps a part 22 in a door 23 to prevent swinging of the door in a direction 24. In inwardly swung, retracted bolt position, as seen in FIG. 4, the overlap of the hook 18*b* and part 22 is removed, so that the door can then swing in direction 24. A torsion spring is typically wrapped about pin 19 to yieldably urge the bolt toward locked position as seen in FIGS. 1–3. One arm of the spring bears against the sub-cover and the other arm ears against the bolt. See FIG. 7 in U.S. Pat. No. 4,986,584 incorporated herein by reference.

Means are typically provided to release the strike bolt for pivoting about the axis of pin 19 for between locked and unlocked positions, as referred to. See said U.S. Pat. No. 4,986,584. Element 83 represents said bolt moving structure.

As referred to, means is provided to be responsive to an increase in temperature (as to a level T) to move into position to block door unlatching movement of the bolt element from door latching position. Such means may advantageously include a blocking part urged in a direction of movement of the blocking part into blocking relation to bolt pivoting toward unlatched position, and a meltable or fusible element preventing such movement of the part until the temperature of the meltable element rises to temperature T, causing melting of that element.

Figure 5:
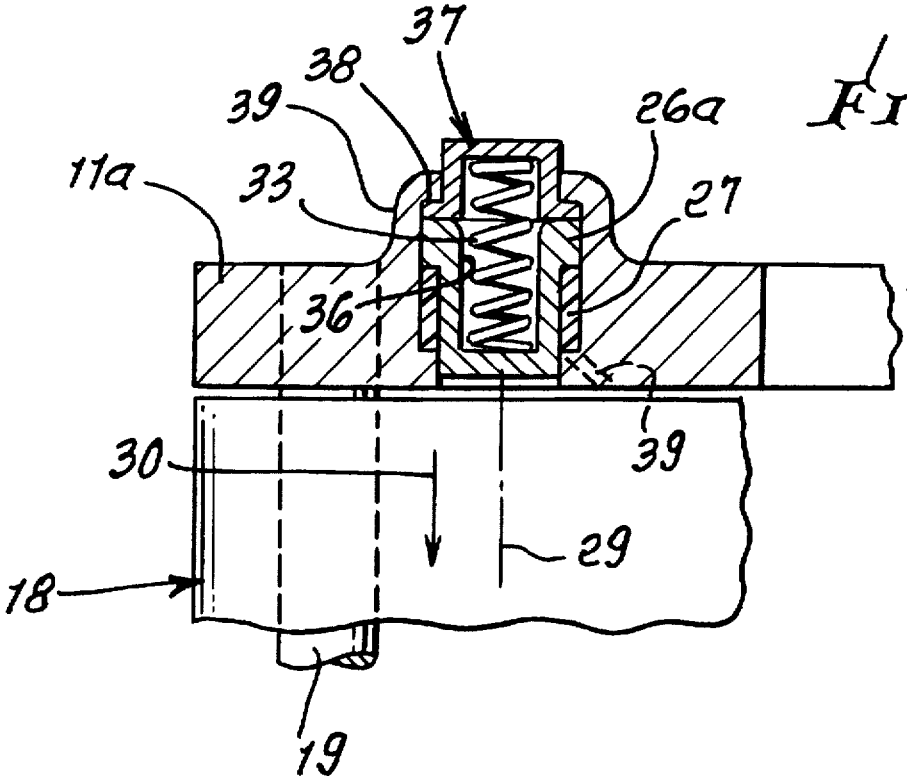
FIG. 5 is an enlarged section taken on lines 5—5 of FIG. 2.

Referring to FIG. 5, a blocking part 26 and a meltable element 27 are shown as located in a chamber such as a bore 28 in the sub-cover 11. The part 26 has the form of a plunger movable endwise in the direction of axis 29. The part 26 has a guide flange 26*a* in sliding engagement with bore 28, and a reduced diameter bolt blocking shank 26*b* projecting in the direction of axis 29, beyond flange 26*c*. This provides a cylindrical space between the shank and the bore, in FIG. 5, for reception of the meltable element 27 extending in obstructing relation to forward movement of the plunger flange in direction 30. The shank 26*b* has sliding engagement with a reduced diameter bore 28*a*, and a step shoulder 31 between bores 28 and 28*a* preventing forward movement of the meltable element 27.

A coil spring 33 in the chamber defined by bore 28 is compressed to urge the blocking part 26 forwardly, flange 26*a* then pressing against the meltable element 27. Element 27 has the form of a sleeve extending about shank 26*a*, as shown. The spring extends within a bore 36 in the plunger, to bear against end wall 26*c*. The upper end of the spring is captivated by end wall 37*a* of a cap 37 secured at 38 to an upwardly protruding portion 39 of the sub-cover.

Figure 6:
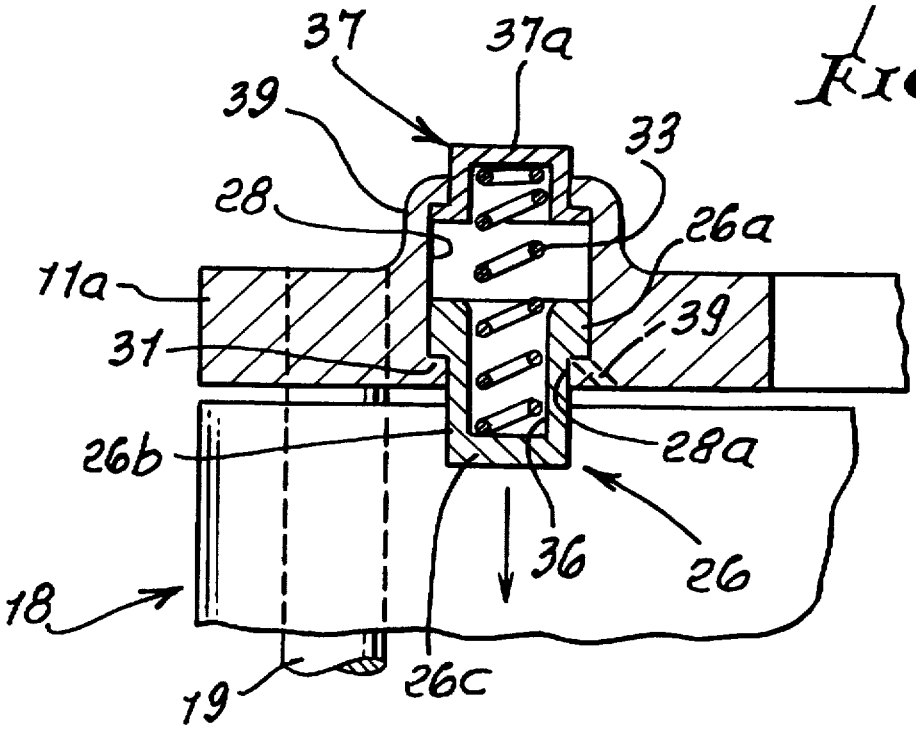
FIG. 6 is like FIG. 6, but showing the plunger in bolt blocking position.

In FIG. 5, the plunger shank 26*b* is held in upwardly retracted position by the meltable element 27, whereby the bolt 18 may swing between door latching and unlatching positions, as in FIGS. 3 and 4. However, if the ambient temperature rises above a selected elevated level T, as during a fire, the element 27 fuses or melts, and drains from its position shown in FIG. 5, thereby allowing the plunger 26 to be displaced downwardly to FIG. 6 position, blocking door unlatching movement of the bolt. See also FIG. 3 showing plunger shank 26*b* moved downwardly adjacent the side wall 18*d* of the bolt, and in offset relation to the pivot pin 19, as shown. At this time, plunger flange 26*a* engages the step shoulder 31.

The meltable element may consist of lead, for example, and may drain from FIG. 5 position as via a drain passage 39 in the sub-cover. The sub-cover itself, and the bolt, normally consist of a metal such as steel that does not fuse or melt at temperature T or temperatures close to T. An example of temperature T is 350° to 450° F.

Figure 7:
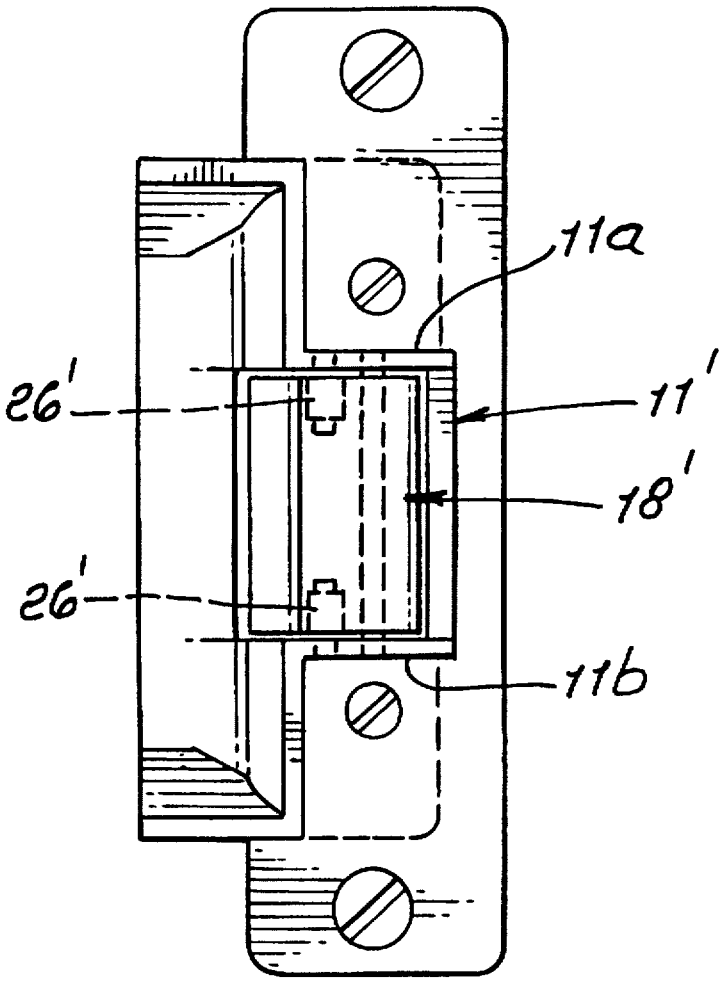
FIG. 7 is a view like FIG. 1, showing a modification.
Figure 8:
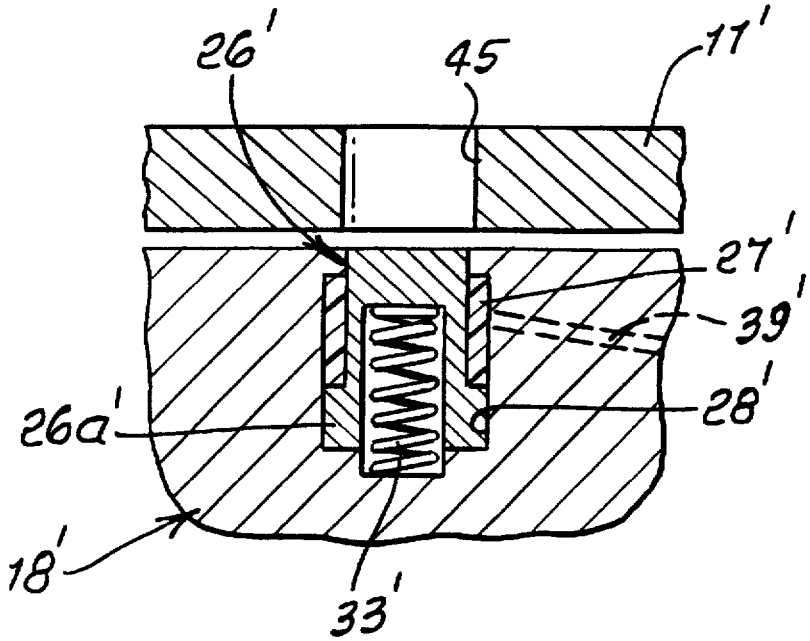
FIGS. 8 and 9 are like FIGS. 5 and 6, but showing modifications.
Figure 9:
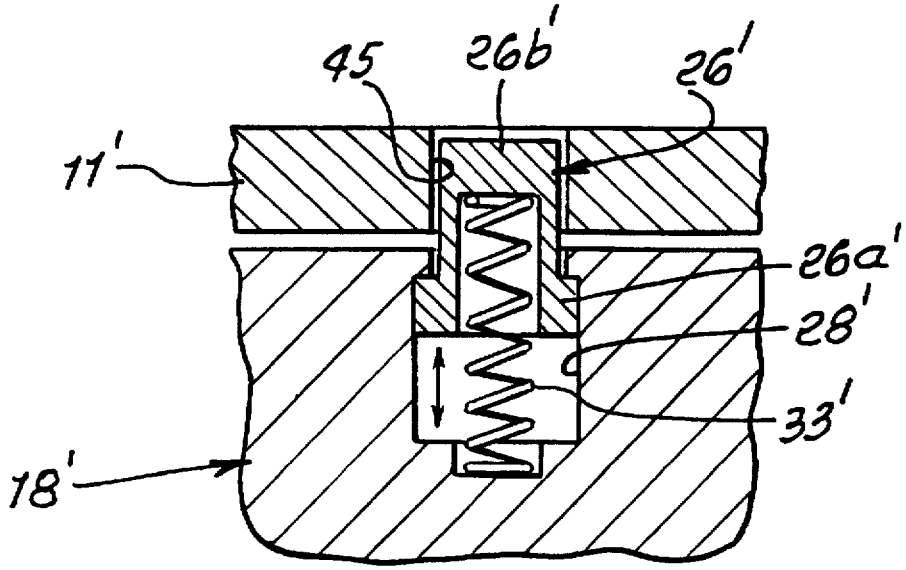

FIGS. 7–9 show a modified form of the invention, in which the plunger 26' and meltable element 27' are carried in a bore 28' in the bolt 18'. Spring 33' urges the plunger upwardly, the plunger flange 26*a'* sliding in bore 28' and pressing against the retained meltable element 27' when the temperature reaches T, element 27' melts and drains out of obstructing relation to plunger movement. See for example drain passage 39' in the bolt and extending to an outer side of the bolt. The plunger is then displaced upwardly, so that its shank 26*b'* enters an opening 45 in the sub-cover 11', as shown in FIG. 9, thereby blocking swinging movement of the bolt in its door latching position. FIG. 7 shows use of two blocking elements 26', at upper and lower ends of the bolt, to engage in openings 45 in sub-cover flanges 11*a* and 11*b*.

I claim:

1. In a door closure assembly, the combination comprising a) a latch bolt element, b) carrier structure to carry the bolt element to pivot between door unlatched and latched position, c) and means carried by a fire resistant portion of said assembly to be responsive to an increase in temperature to a level T to move into position to block door unlatching movement of said bolt element from door latching position, there being a chamber in said portion of the assembly, d) said means including a blocking part urged in a direction of movement of said part into blocking relation to bolt pivoting toward unlatched position, and a meltable element preventing said movement of said part until the temperature of said meltable element rises to temperature T causing melting of said element, e) said blocking part comprising a plunger movable in said chamber in said direction, said meltable element also positioned in said chamber, said plunger having a flange and a blocking shank projecting in said direction beyond said flange, and said meltable element is positioned to extend about said shank to obstruct movement of said flange in said direction, said means including a spring in said chamber urging said blocking part in said direction, said meltable part extending annularly about said shank and said spring.

2. The combination of claim 1 wherein said means is carried by one of the following:

said carrier structure said bolt.

3. The combination of claim 1 wherein said carrier structure includes a metallic plate and a metallic sub-cover carried by the plate, said means carried by said sub-cover.

4. The combination of claim 1 wherein said means is carried by said carrier structure.

5. The combination of claim 1 wherein said means is carried by said carrier structure, which comprises a sub-cover.

6. The combination of claim 1 including a cap associated with said chamber and retaining said spring in said chamber, said flange also extending about the spring, in said chamber.

7. The combination of claim 6 wherein said plunger has a bore into which said spring extends.

8. The combination of claim 7 wherein said means is carried by said bolt.

9. The combination of claim 1 wherein said means is carried by said bolt.

10. The combination of claim 9 wherein said means comprises two blocking plungers, located at opposite ends of the bolt.

* * * * *